US008478660B2

(12) United States Patent
Toro Escudero et al.

(10) Patent No.: US 8,478,660 B2
(45) Date of Patent: Jul. 2, 2013

(54) METHOD AND SYSTEM FOR IMPROVING THE SELECTION OF SERVICES IN A SERVICE EXCHANGE ENVIRONMENT

(75) Inventors: Maria Aranzazu Toro Escudero, Madrid (ES); Sergio Garcia Gomez, Madrid (ES)

(73) Assignee: Telefonica, S.A., Madrid (ES)

( * ) Notice: Subject to any disclaimer, the term of this patent is extended or adjusted under 35 U.S.C. 154(b) by 134 days.

(21) Appl. No.: 13/111,218

(22) Filed: May 19, 2011

(65) Prior Publication Data

US 2012/0296755 A1 Nov. 22, 2012

(51) Int. Cl.
*G06Q 30/00* (2012.01)

(52) U.S. Cl.
USPC ..... 705/26.41; 705/26.1; 705/26.61

(58) Field of Classification Search
USPC ..... 705/7.11, 7.29, 7.36–7.42, 26.1–27.2
See application file for complete search history.

(56) References Cited

U.S. PATENT DOCUMENTS

| | | | | |
|---|---|---|---|---|
| 7,386,483 | B1 * | 6/2008 | Lee et al. | 705/26.3 |
| 8,126,779 | B2 * | 2/2012 | Wanker | 705/26.1 |
| 2006/0053063 | A1 * | 3/2006 | Nagar | 705/26 |
| 2007/0011058 | A1 * | 1/2007 | Dev | 705/26 |
| 2007/0136775 | A1 * | 6/2007 | MacKay et al. | 725/106 |
| 2009/0070185 | A1 * | 3/2009 | Farrelly | 705/10 |
| 2010/0131412 | A1 * | 5/2010 | Bradley et al. | 705/59 |
| 2011/0208617 | A1 * | 8/2011 | Weiland | 705/27.1 |
| 2011/0252031 | A1 * | 10/2011 | Blumenthal et al. | 707/733 |

FOREIGN PATENT DOCUMENTS

WO 01/99003 12/2001

OTHER PUBLICATIONS

"CommerceScout™ Partner with MANEX Systems to Broaden Customer's Reach in the Electronics Marketplace". Newport Beach, CA. Aug. 22, 2000.*

* cited by examiner

*Primary Examiner* — William Allen
(74) *Attorney, Agent, or Firm* — Katten Muchin Rosenman LLP

(57) ABSTRACT

A method and a system for improving the selection of a group of services, in an exchange services environment, by a user of a telecommunication network. The following steps are comprised by the invention: defining a first set of requirements in a selection criteria manager module to be fulfilled by the services; performing a search among all services available, according to services functionalities defined in a service catalog and matching the first set of requirements; discarding services which do not fulfilled the first set of requirements; defining a second set of requirements in the selection criteria manager module, the second set of requirements indicates user preferences; assigning weights to the services taking into account the second set of requirements, data from an historical information module of previous selections of the user, data from a profile of the user with previous preferences; arranging all service combination according to the weights obtained, being the first one an optimal selection; storing the selection of the user at the historical information module.

11 Claims, 11 Drawing Sheets

METHOD AND SYSTEM FOR IMPROVING THE SELECTION OF SERVICES IN A SERVICE EXCHANGE ENVIRONMENT

TECHNICAL FIELD OF THE INVENTION

The present invention relates generally to exchange and composition of services and more specifically to the intelligent composition of services in an electronic marketplace.

BACKGROUND OF THE INVENTION

In the recent years, service providers are facing the emergence of new business models based on collaboration with third parties. Companies compete in some areas but associate in others in order to complement their expertise and get synergies.

These changes affect sectors such as Internet, IT and telecommunications, but also providers of non-electronic services. For example, in traditional models the telco, as network provider, pays service providers and charge end users for the use of their services. The new approach is to collaborate with third parties, allowing them to use some telco capabilities (billing, communications, . . . ) to improve their service quality and paying for them or sharing benefits. In the broader new generation business environment concept, not just companies can act as service providers, but also individual developers.

A good example is the case of application stores and open environments, where professional and amateur developers can develop and sell applications under several business models, which are usually simple. The most successful application store is currently Apple AppStore, but many terminal manufacturers and operating system providers also have theirs or plan to launch it: Google, Blackberry, Microsoft, Palm, Nokia . . . .

When the environment operator is a telecommunications company, developers can use functionalities such as SMS, location of billing thanks to the use of open APIs provided by the telco. Most operators have some initiative in this line, like Telefónica Open Movilforum, Telefónica Europe Litmus2, Orange Partners Program or Vodafone Betavine.

The eMarketPlace concept goes much further in this line of collaboration with third parties. The eMarketPlace is a new generation business environment where provider can publish services, applications and products in a managed environment, which controls the business models (prices, revenue sharing, promotions) that are applied for their contracting and use. The eMarketPlace allows providers (both companies and individuals) the reuse of components that are published by third parties to compose complex services, thus reducing the effort they would need to invest if they had to develop the complete functionality by themselves. Composed services can in turn be published in the eMarketPlace and commercialized under predefined business models.

How services are published by service providers and discovered by other service providers in an eMarketplace is shown in FIG. 1. Service provider 1 (1) publishes service 1 (5) in the eMarketPlace (4). Service providers 2 (2) and 3 (3) publish services 2 (6) and 3 (7). Another service provider 4 (9) wants to find services to reuse them as part of a composed service. Descriptions and business models of all services in the eMarketplace (4) are checked by accessing a service catalog (8). When the service provider 4 (9) finds the services that fit his needs, the service is selected and contracted.

How the eMarketPlace offers composed services is shown in FIG. 2. Once service provider 4 (9) has selected the components that are useful for him, service 2 (6) and service 3 (7), and contracted them, he composes a new service (10), that uses service 2 (6) and service 3 (7), and publishes it in the eMarketPlace (4). By adding a commercial offer to this service, it can be purchased by a customer (11), who discovers it via the service catalog (8). The customer (11) does not need to know how many providers are contributing to it (the eMarketPlace will be in charge of managing the relationship with all the providers).

A simplified eMarketPlace architecture based in the TMForum Software Enabled Services Management Solution (SES MS, former Service Delivery Framework) reference architecture, with the main modules that it could include is shown in FIG. 3. The eMarketPlace (4) is accessed by customers (11) and service providers (1) through some user layers (12) where they have facilities to search for services and products, get reports of their incomes or expenses, etc.

Services 1 (5) and 2 (6) can be deployed in any infrastructure (19), but its descriptions are stored in the service catalog (13). It contains functional description of the services, the interfaces to access them, their KPIs, etc. It also contains the business model that is assigned to the service when the provider publishes it. The business model includes the pricing model, the Service Level Agreement, or SLA (14), that are offered, the revenue share model (16) that determines how to distribute the incomes between the provider and the eMarketPlace owner, etc. Business models are defined in the business model catalog (17).

When services are purchased and used, the service quality is measured by a quality of service, or QoS, module (15). QoS is used to determine when the SLA that has been contracted by the customer is violated. This is accomplished in module (14). SLA violations involve penalties for the service provider.

A Business Support System, or BSS, module (18), which can be external to the eMarketPlace, is in charge of charging customers for the use of services (customers can be either end users or providers that use services in their composed services). BSS module (18) is also in charge of paying service providers according to the incomes generated by their services. The amounts to be paid are provided to BSS module by the settlement and revenue sharing calculation module (16). So 16 controls the total incomes generated by each service and the distribution of those incomes among service providers and eMarketPlace owner.

The settlement and revenue sharing module calculates the amounts to be paid to service providers for the incomes generated by their services as informed by the BSS module, taking into account if those services are composed or are components of composed services (as revenues must be distributed among all providers that are involved in the composition). The settlement and revenue sharing module also needs to get the business model of the services, from the business models catalog, to identify the revenue share model and the penalties for SLA violation. Those SLA violations are reported by the SLA module.

Although some companies are launching systems and tools for the commercialization of services and applications, there is no eMarketPlace in the market that includes service and application composition and complex business model definition.

Nowadays, the use of cloud infrastructures is gaining importance, and this is the trend for the next years. A cloud infrastructure can have an associated eMarketPlace for the commercialization of the many services that are deployed in the infrastructure. These services are often offered under a SaaS (Software as a Service) model, in which the user does not install the service in his equipment but it remains in the provider infrastructure and is paid per use. It is usual that some service providers create bundles of SaaS services that they offer to third parties. In this kind of environments, it would be very interesting for the development of composed services, as well as for the bundle creation, to have tools that automatically select the optimal combination of service components by evaluating a number of factors that determine the quality of the combination based on user-configured criteria.

Selecting the most appropriate components to build the composed services or applications is key for the success of a service eMarketPlace. However, this is a complex task, as many aspects should be taken into account. When the number of actors participating in the eMarketPlace grows and the volume of available services increases, it can be extremely difficult for a user to find the ideal components for his composed service on his own. The user does not have detailed access to all the needed information, and even if he had, it might be impossible for him to handle and process such volume of information and come to the right conclusions.

Thus, it is necessary to provide users with tools that perform such selection in an automatic way, taking into account all the relevant factors of the components (functionality, price model, revenue sharing model, SLAs, QoS, success, customer feedback). As it is not possible to find a collection of services or applications that are optimal in all criteria, it is necessary to find the optimal combination by balancing their value for each of them. Besides, all these factors do not be equally important for all users, so the optimization mechanism should give higher weight to some according to subjective perceptions.

Another important issue when the selection of components is completed is the definition of the business terms and conditions of the service that composes all of them. Those terms and conditions follow some rules and restrictions due to the terms and conditions of the aggregated components, and those depend on the policies that are defined in each eMarketPlace.

There are some solutions to help select products in electronic eMarketPlaces as patent WO 01/9903 A1, but there is no service composition involved. It is aimed at selecting individual products as compared to other products in the eMarketPlace, not to selecting groups of interrelated services where there is a need to balance the score of each of them for the selection criteria and take into account the constraints that the individual business models impose to the models of the composed service.

SUMMARY OF THE INVENTION

The present invention serves to solve the aforesaid problem by providing a method and a system for improving the selection of a group of services in an exchange services environment, that is preferably an electronic eMarketPlace, by a user of a telecommunication network. The following steps are comprised by the invention:

- defining a first set of requirements in a selection criteria manager module to be fulfilled by the services;
- defining a second set of requirements in the selection criteria manager module, the second set of requirements indicates user preferences;
- making pairwise comparison of criteria and subcriteria in order to feed the AHP algorithm.
- performing a search among all services available, according to services functionalities defined in a service catalog and matching the first set of requirements;
- discarding services which do not fulfill the first set of requirements;
- assigning weights to the services taking into account the second set of requirements, data from an historical information module of previous selections of the user, data from a profile of the user with previous preferences;
- arranging all service combination according to the weights obtained, being the first one an optimal selection;
- storing the selection of the user at the historical information module.

The invention may be implemented using an Analytic Hierarchy Process based algorithm for assigning the weights to the services taking into account the second set of requirements and data from an historical information module of previous selections and from a profile of the user with previous preferences.

A user of the invention may be, in turn, a service provider of a second user, selecting services to be added to the services provided by said service provider to offer a composed service.

Preferably, the invention includes collecting a feedback about the services, checking a quality of service, checking a service level agreement and checking information about the incomes generated by each service in order to complement, as much as possible, the preferences of the users and service providers.

A second aspect of the invention refers to a system adapted to perform the steps of the depicted method. The system comprises a module called Intelligent Composition Module, also called ICM, that comprises the following modules:

- a selection criteria manager (30) for defining a first and a second set of requirements for the composed services;
- a selection engine (34) for performing the selection of services according to the all requirements defined in the selection criteria manager and searching among all possible service combinations;
- a profile manager (28) for providing information about previous preferences of a user, stored in a profile repository (29);
- an historic information repository (32) for storing previous selections of the user.
- a weight calculation module (33) for weighting a selection criteria according to the second set of requirements and data from the profile and data from an historic information repository;
- a composition support (31) for offering to the user or services provider an optimal composition of services according to the weights;

Also a computer program is provided in order to perform the steps of the method running on a general purpose processor, a digital signal processor, a FPGA, an ASIC, a microprocessor, a micro-controller, or any other form of programmable hardware.

The described invention allows users selecting components for their eMarketPlace composed services according to criteria that they cannot evaluate on their own:

- They do not have access to the necessary information (e.g. they do not have access to QoS statistics of all services exposed in the eMarketPlace).
- Even if they had, it would be a too complex task to be performed manually if the number of services is not very small.

This results in composed services that fit in the provider requirements and strategy.

It also guides them through the process of defining the business models for their composed services and applications, preventing them from selecting incorrect pricing models or SLAs.

The addition of both advantages results in more efficient services, better focus in functionality and prices to their objective public, and thus more successful. Providers gets higher revenues and customers will be more satisfied.

The above features and advantages do not limit the present invention, and those skilled in the art will recognize additional features and advantages upon reading the following detailed description, and upon viewing the accompanying drawings.

DESCRIPTION OF THE DRAWINGS

To complete the description that is being made and with the object of assisting in a better understanding of the characteristics of the invention, in accordance with a preferred example of practical embodiment thereof, accompanying said description as an integral part thereof, is a set of drawings wherein, by way of illustration and not restrictively, the following has been represented.

DETAILED DESCRIPTION OF THE INVENTION

Figure 4:
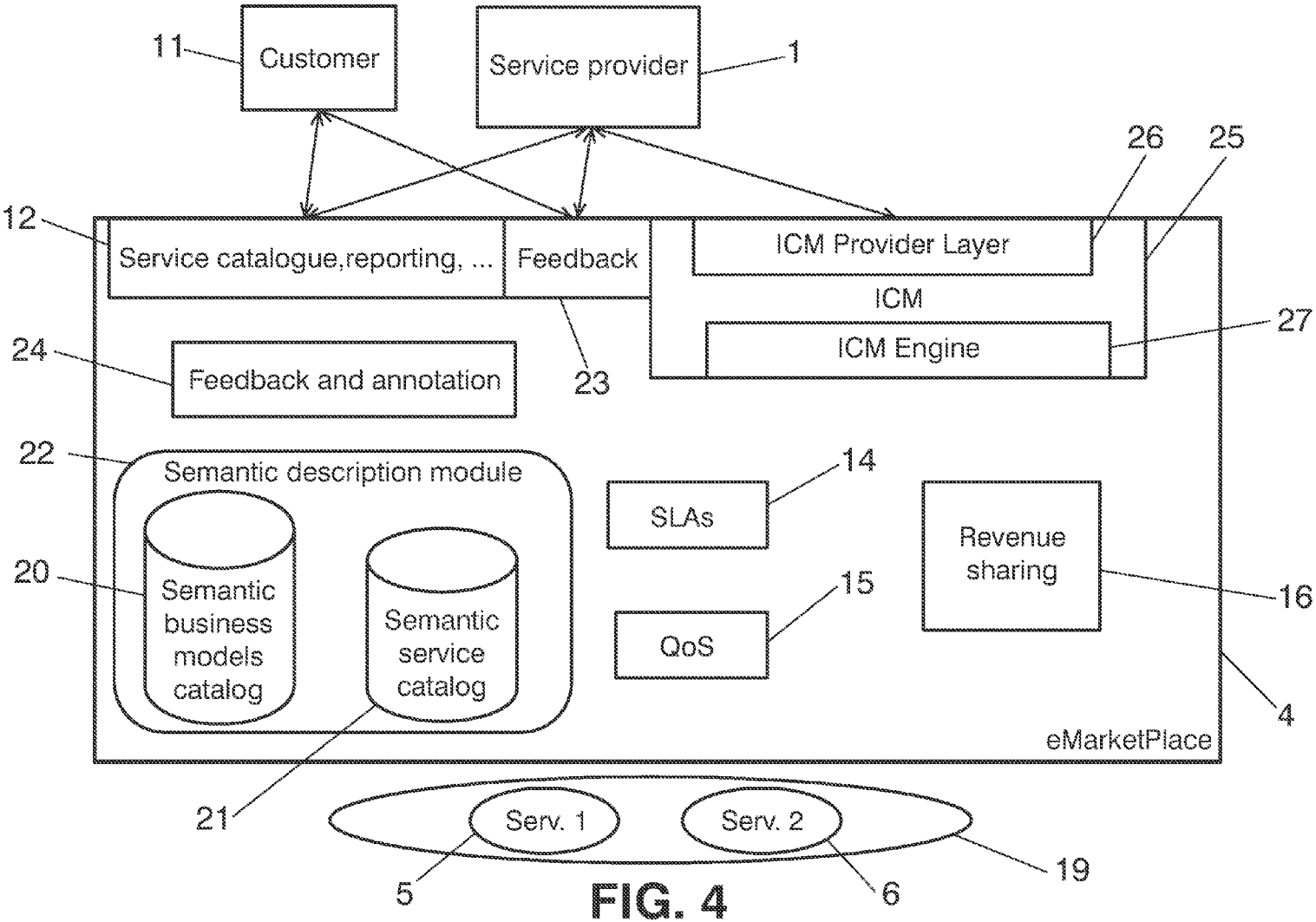
FIG. 4 represents the architecture proposed in present invention to support business model and service composition in an eMarketPlace.

The invention follows an architecture to support business model and service composition in an eMarketPlace that is shown in FIG. 4.

Figure 1:
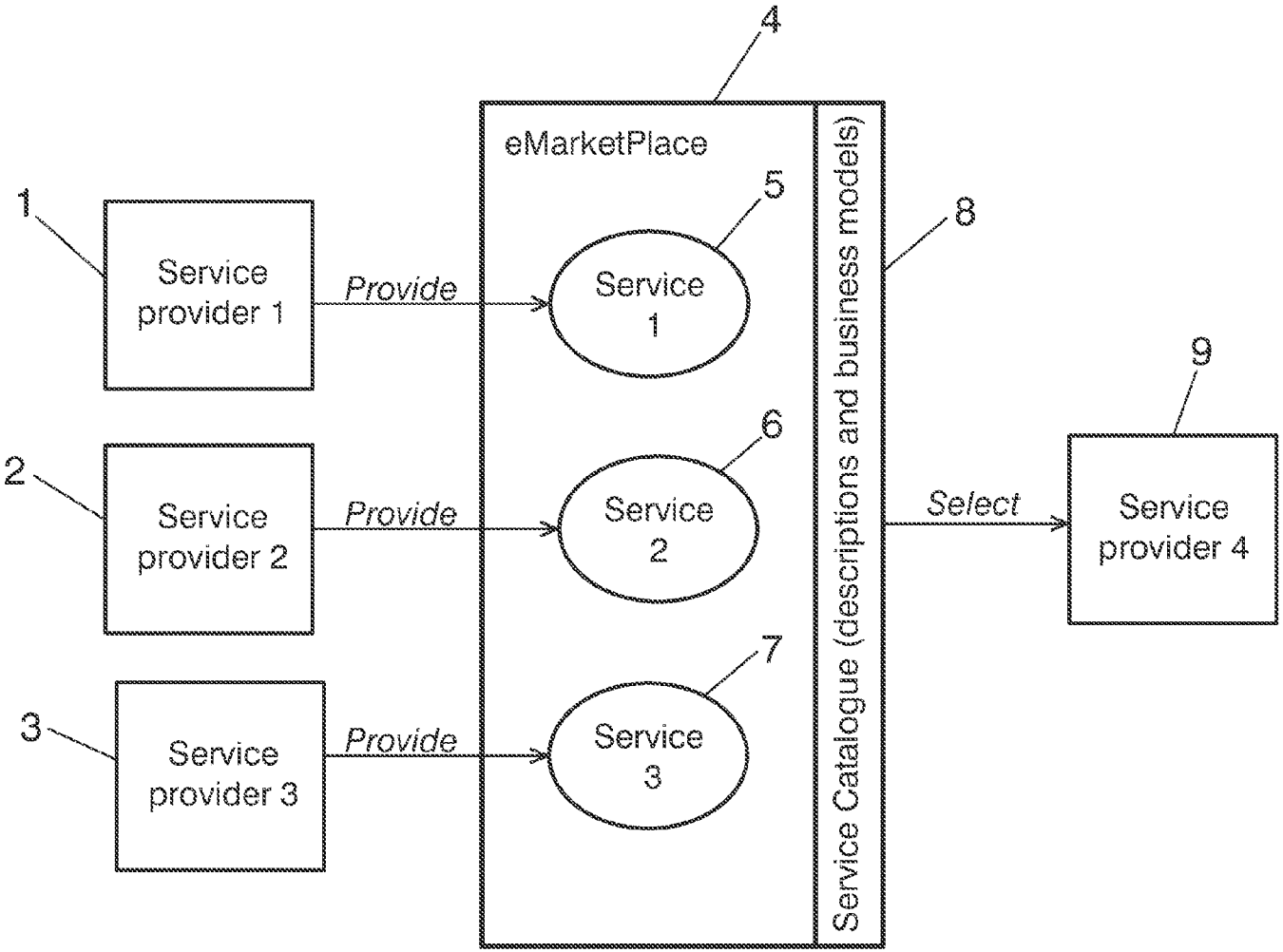
FIG. 1 shows how services are published by service providers and discovered by other service providers in the prior art.
Figure 2:
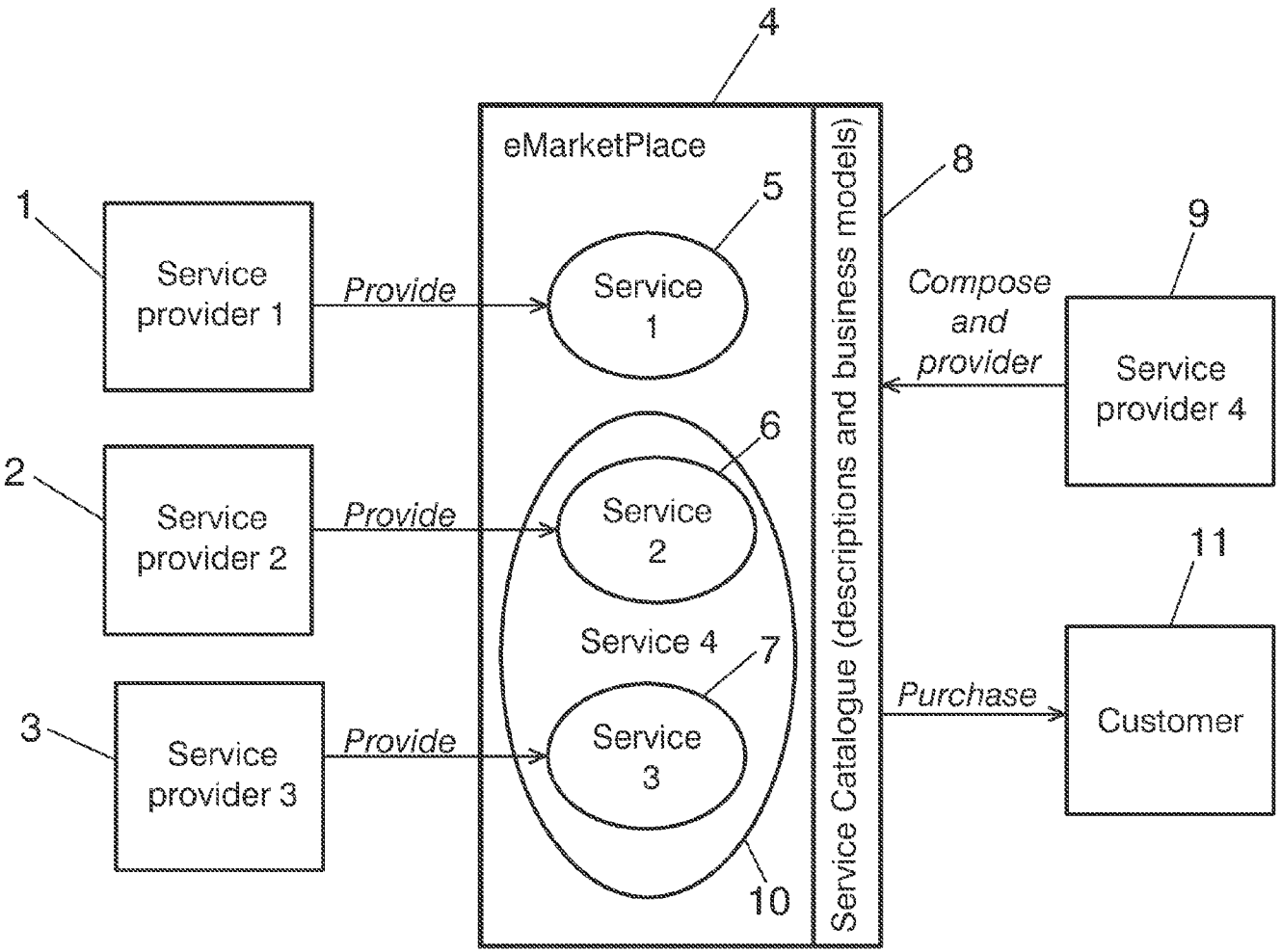
FIG. 2 shows how an eMarketPlace offers composed services in the prior art.
Figure 3:
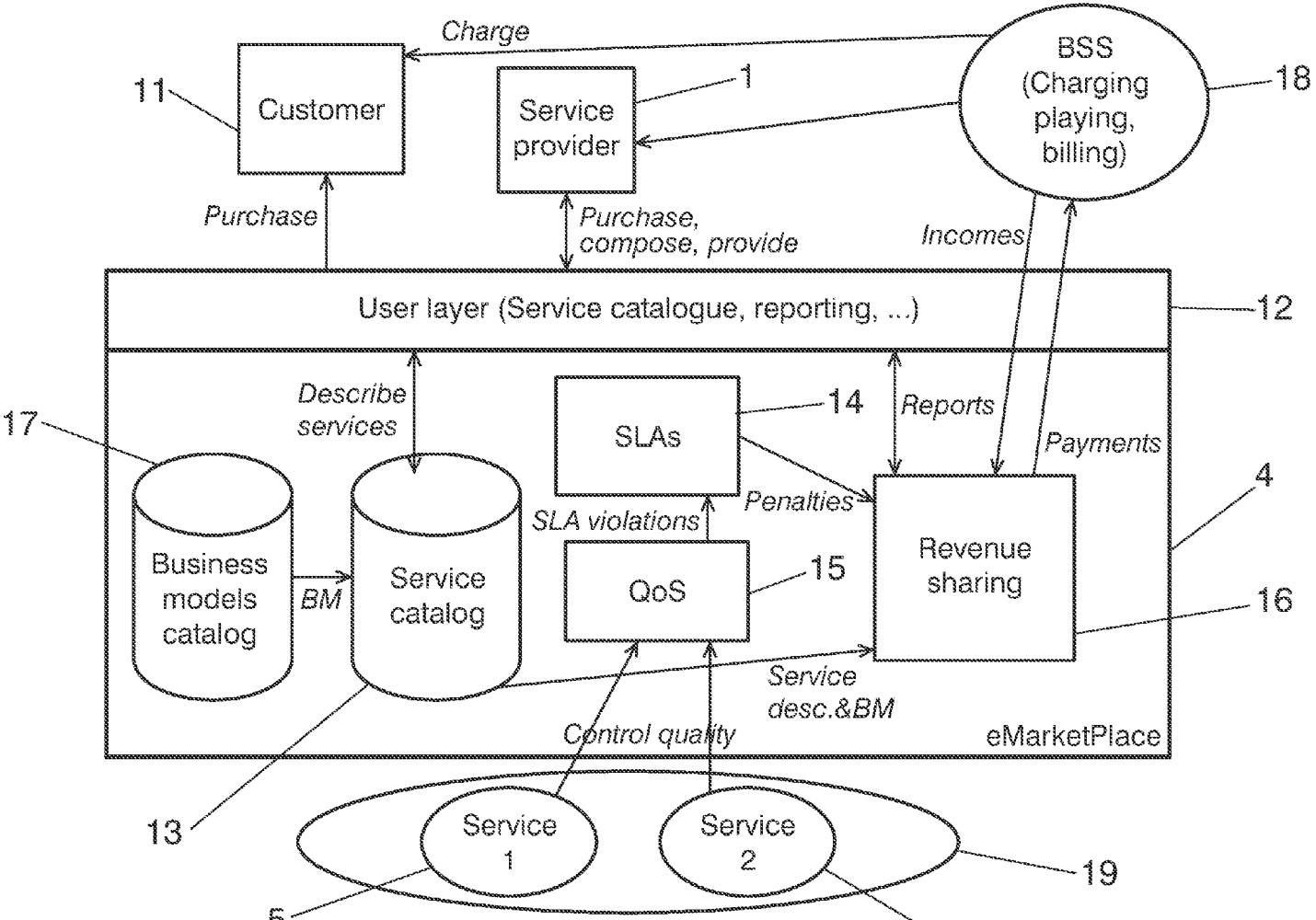
FIG. 3 shows a simplified eMarketPlace architecture with the main modules that it includes.

As in the general eMarketPlace architecture described in FIG. 3, the Service Provider (1) and the Customer (11) can interact with the eMarketPlace (4) through a user layer (12) that comprises the service catalog and reporting functionalities.

As in FIG. 3, there is a QoS module (15) that measures the service quality and a SLA module (14) that calculates SLA violations. There is also a Revenue Sharing module (16) in charge of calculating the distribution of incomes among service providers and eMarketPlace owner.

As in FIG. 3, the system proposed in FIG. 4 includes catalogs to manage the service and business models descriptions, but whereas (13) and (17) might use any procedure and format to store those descriptions, the proposed Semantic Service Catalog (21) and Semantic Business Models Catalog (20) require semantic descriptions of the elements.

The proposed system also adds a Feedback interface (23) and Feedback&Annotation module (24) that are used to collect customer and provider feedback about the service in the eMarketPlace that is used to enrich their descriptions or to identify the most popular services or, on the contrary, those who are not well accepted.

Finally, the proposed architecture adds the Intelligent Composition Module (ICM), (25), which is the element in charge of identifying the set of components that best fit the provider requirements and supports him in the definition of the composed business model. This module is composed of the ICM Provider Layer 26 that contains the interface with the Service Provider (1) in order to collect the selection criteria and provide the results of the selection, and the ICM Engine (27) that performs the calculation.

The ICM (25) receives information from the rest of the modules, as it is described in detail in the next sections:

- Service descriptions (21): Semantic descriptions allow the ICM to understand the functionality provided by each service.
- Business model descriptions (20): Semantic descriptions will enable the selection of the models that fit with the provider preferences and with the models of the rest of the components.
- QoS (15): Information about the performance of each of the services in the eMarketPlace.
- SLA performance (14): Information to identify which services are violating SLAs.
- Revenue sharing (16): information about the incomes generated by each service and the share of the incomes that are received by the providers.
- User and provider feedback (24): Information about how the services are perceived by users, which services generate higher satisfaction, etc.

Architecture of the ICM

Figure 5:
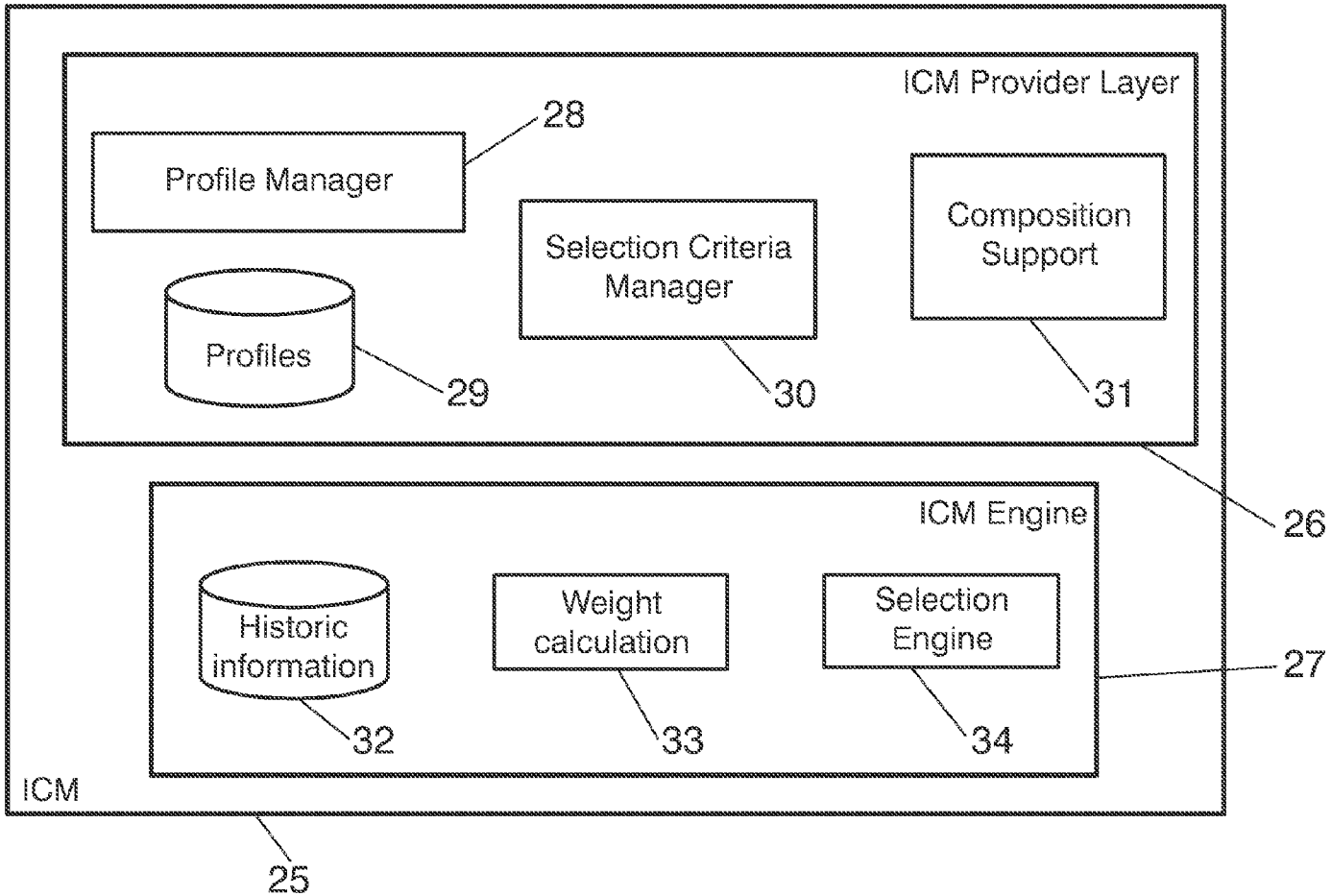
FIG. 5 describes the architecture of the module called "Intelligent Composition Module".

FIG. 5 describes the architecture of the ICM (25).

As previously explained, the ICM (25) is composed of the ICM Provider Layer (26) and the ICM Engine (27).

The ICM Provider Layer contains the following modules:

- Profile Manager (28), in charge of generating profiles of the providers in order to adapt the component selections to their preferences and needs. The profiles are stored in repository (29).
- The Selection Criteria Manager (30), in charge of collecting and processing the provider criteria for the component selection.
- The Composition Support module (31), in charge of supporting the provider in the composition process by offering him a set of component selections that fit with his criteria and helping him with the definition of the business terms and conditions for the final choice of components.

The ICM Engine (27) contains the following modules:

- The Historic Information repository (32), that stores previous selections in order to enhance future selection processes.
- The Weight Calculation module (33), that generates the set of weights to be used in the selection process.
- The Selection Engine (34), that performs the component selection.

Functionality of these modules is explained in more detailed:

Profile Manager (28)

The Profile Manager (28) provides information about the customer and provider preferences that can be helpful to complement the criteria defined by the provider for the component selection. Customer and provider profiles may be provided by external systems, but they are also fed by their behaviour in the eMarketPlace environment and by their feedback.

Knowing which services the provider has published and contracted and their characteristics will be very valuable when selecting components for him in the ICM. For example, if the provider always works with components that have very restrictive SLAs, it can be assumed that service level is an important factor for him. If the provider has always contracted and published very cheap services, it can be assumed that low price is something he will look for when selecting new components.

In a similar way, knowing which services are more often contracted and more highly rated by customers help identifying the components that can be more successful when being used in a composed service.

Customer and provider profiles are stored and updated in a profiles repository (29).

Selection Criteria Manager (30)

The ICM works with a number of criteria that are configured by the provider. Following an AHP (Analytic Hierarchy Process) approach, a number of criteria have been defined. These criteria can be decomposed into several subcriteria. All the criteria must be pairwise compared, as well as all the subcriteria of the same criteria. The following list is an example of top level criteria:

C1: Functionality required by the user.

C2: Preferred number of components.

C3: Composed service SLA

C4: Composed service required price.

C5: Total price margin for the composed service provider.

C6: Compose service revenue share.

C7: QoS (the objectives must be defined according to different KPIs as subcriteria).

C8: Service statistics (better valued services, more frequently used services, services with higher incomes).

The definition of priorities is based on a two phases approach. For every criteria, it can be defined a hard condition (included in a first set of requirements) or a soft condition (included in a second set of requirements). In the case of hard conditions, they behave as filters, avoiding including in the services ranking any service composition that does not match these criteria. On the other hand, soft conditions are used to pairwise compare all the services combinations for every criterion.

Not all providers give the same importance to all the criteria. A provider might consider that the total price is much more important that the QoS features, and slightly more important than the revenue share models. Another provider could prioritize QoS and Service Statistics (and among them, the better valued services) over the business criteria.

The Selection Criteria Manager 30 includes a provider interface where the provider has access to the complete list of selection criteria, configures them and prioritizes them according to the relative importance they have for him. To define these priorities, the provider uses the Selection Criteria Manager (SCM) (30) in the following way:

The SCM allows the provider to define hard criteria, that is, conditions that all the ranked service combinations must match.

The SCM offers the tools to define the criteria and subcriteria, that is, to select the conditions that allow the Selection Engine to compare two services combinations regarding a given criteria.

The SCM supports the provider in the subjective comparison of every criterion with each of the others. It also allows the pairwise comparison of groups of subcriteria. As an example, the subjective comparison values can be: same importance, slightly more important, more important, strongly more important or extremely more important.

Figure 6:
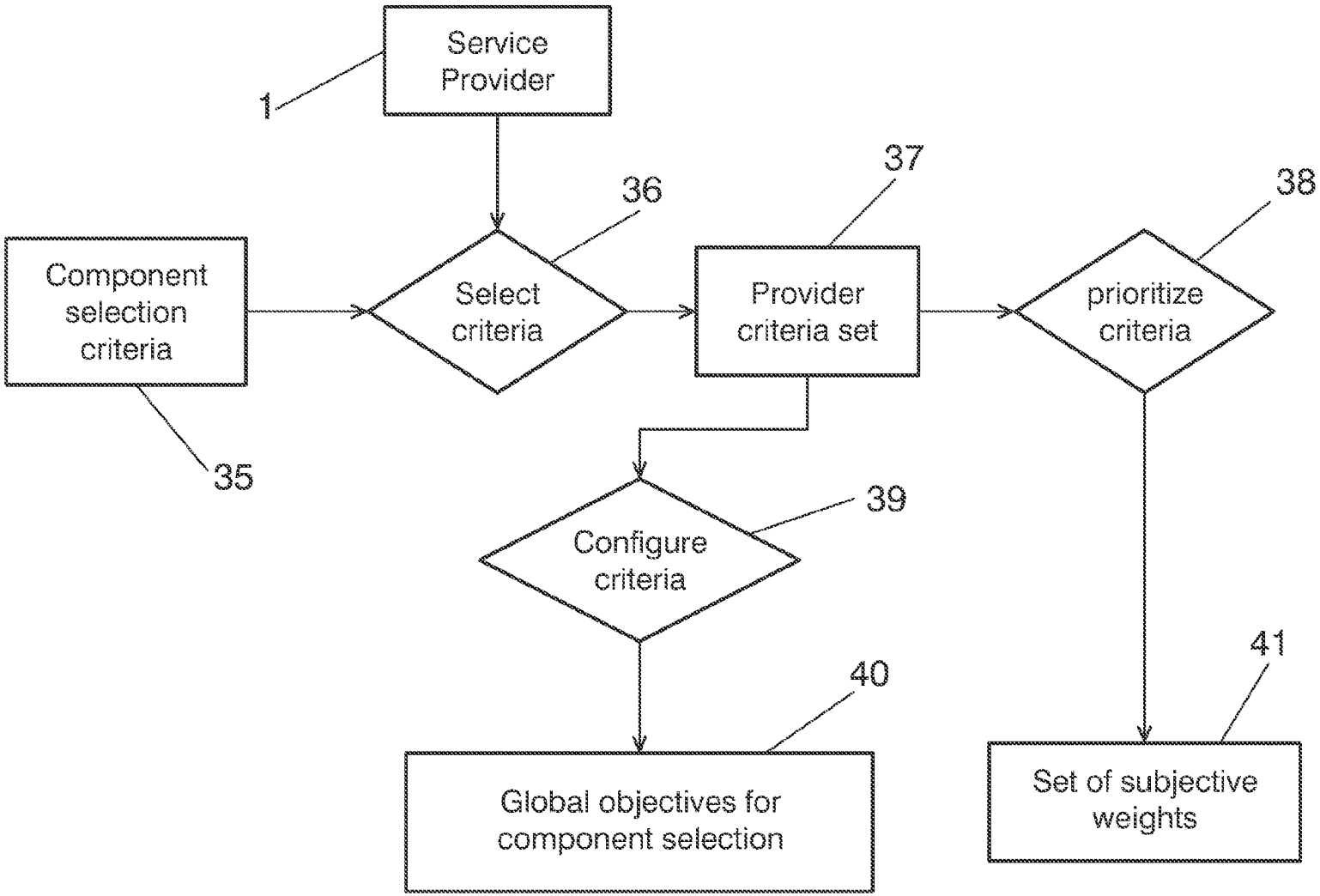
FIG. 6 shows the flow related to the Selection Criteria Manager.

The flow related to the Selection Criteria Module is shown in FIG. 6. The Service Provider (1) gets the list of selection criteria (35) and selects those that are of interest for him (36), obtaining the set of provider criteria (37). He configures the selected criteria and subcriteria (39). The result is the set of objectives for the component selection (40). Those will be fed to the ICM engine (27).

Besides, he assigns priorities to the criteria (38) and a set of subjective weights (41) is obtained through the application of the AHP-based algorithm. Those are fed to the Weight Calculation Module (33) to contribute to the final set of weights that will be applied to the selection criteria in (34).

Composition Support Module (31)

This module helps the provider in the service composition from two different perspectives:

If offers optimal component combination obtained from the ICM Engine (27) according to the criteria defined in the SCM module (30) and taking into account the provider and customer profiles (29). The best option is shown to the provider together with a ranking of the next best options, with information that allows him to select the preferred one.

Figure 7:
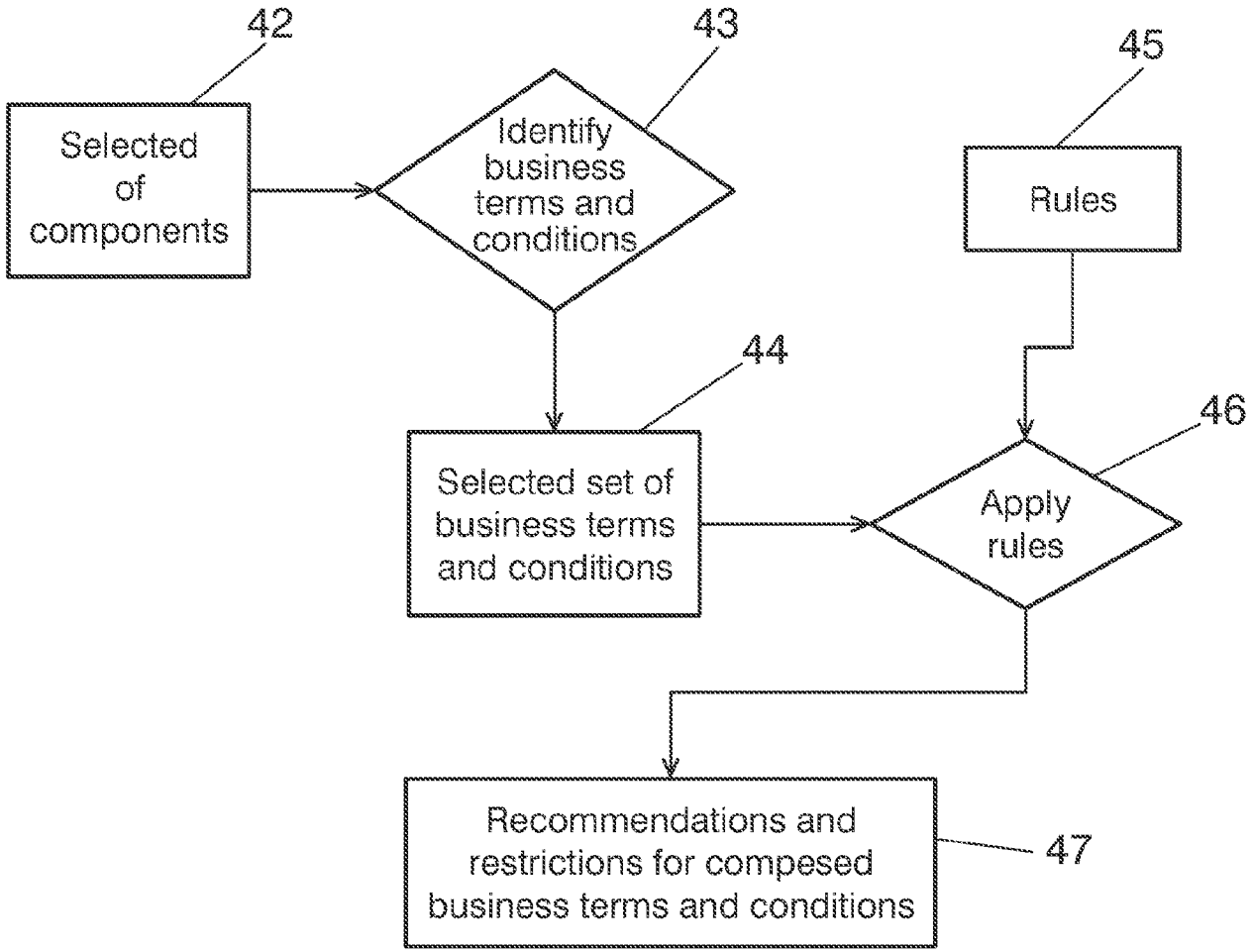
FIG. 7 shows the process followed to support business terms and condition compositions.

It helps to define the composed service business model depending on its components. In order to do that, it indicates the restrictions in prices and SLAs, the revenue share, etc. FIG. 7 shows the process that is followed. The Composition Support module (31) takes the set of components selected by the provider (42) and identifies (43) the associated business terms and conditions (44). There is a predefined set of rules (45) that are applied (46) to the selected set of business terms and conditions (44) in order to obtain the set of recommendations and restrictions (47).

For example, one of the rules might dictate that the composed price model must be a superset of the price models of all the components. In this case, if one of the components has a pay-per-event price of 1 € and another component has a monthly fee of 20 €, (47) would include the restriction: "the composed price model must at least have a pay-per-event price of 1 or more euros and a monthly fee of at least 20 euros".

Historic Information Module (32)

This module stores the sets of components that are selected by the ICM linking them to the global objectives (40) obtained from the SCM module (30) and to the final sets of components selected by the provider in the Composition Support module (31). This information is used for future selections, as it is a source of intelligence and enables automatic learning of the system.

Weight Calculation Module (33)

This module weights the different selection criteria that exist in the system according to the priorities assigned by the provider (38) and following an AHP based algorithm. To define these weights, the module takes also into account the analysis of historic information (32) and the profile preferences defined in the Profile Manager module (28).

Selection Engine (34)

This module performs the optimal selection of the services that the provider can use to build his composed service, according to the criteria defined in the Selection Criteria Manager (30). In general, it does not select just one set of components but a number n of sets, the n best ones, so that the Provider has a final choice.

In order to do the selection, the Selection Engine (34) uses information provided by other eMarketPlace elements. Mainly:

- Semantic descriptions of both the services and the business models that can be applied to commercialise those services.
- Service usage information.
- Quality of service information.
- SLA violation information
- Service income and revenue share received by the providers.
- Service evaluation from other users, this is, subjective service perception.

The module pairwise compare all possible service combinations, measuring the similarity of the information gathered for every service, with the objective value (definition of each criteria) that is obtained from the information provided by the user (31) and his profile (30) It also dismisses all the combinations that do not comply with the definitions.

Figure 8:
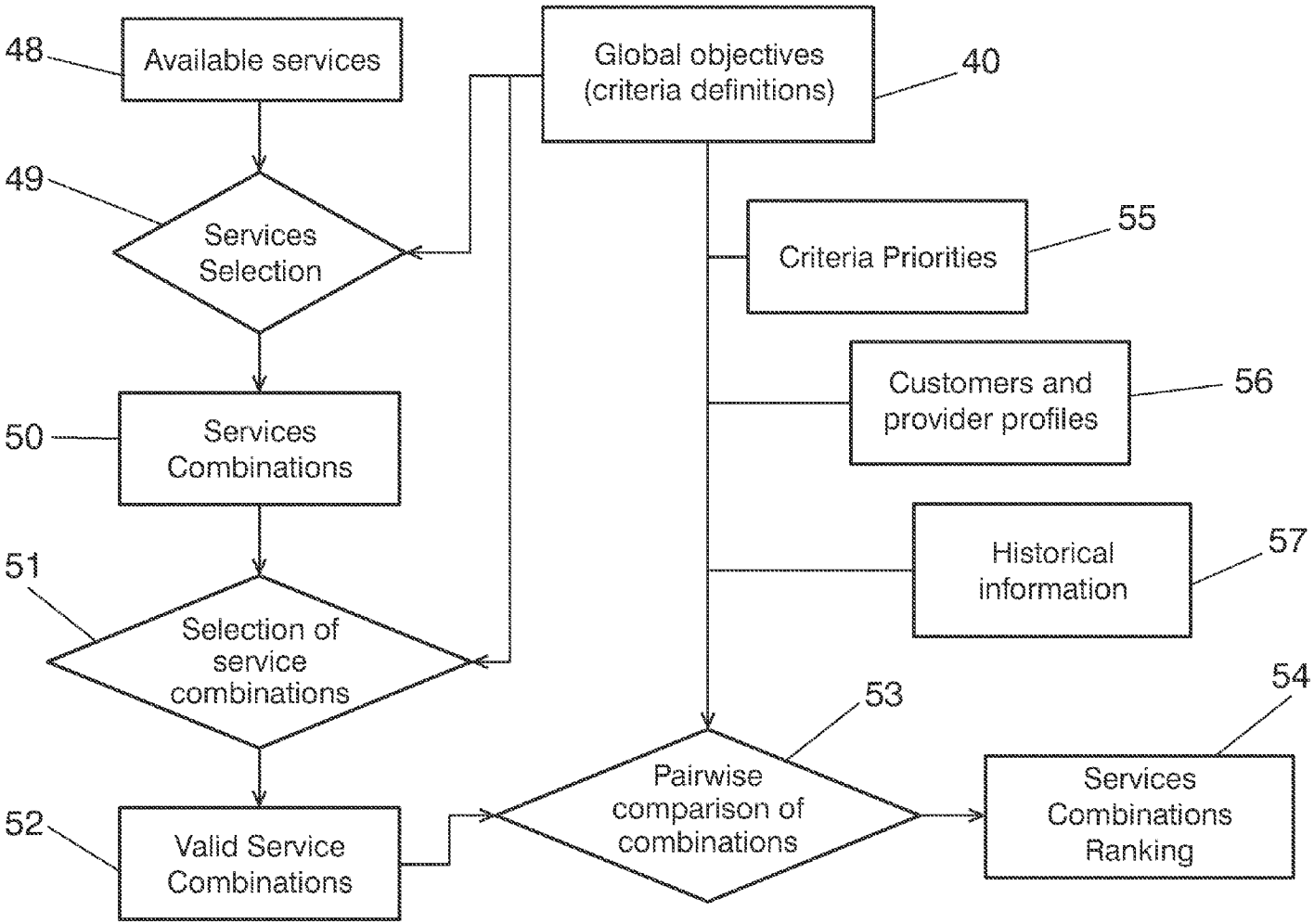
FIG. 8 shows the process followed in the Selection Engine module.

The process followed in this module is shown in FIG. 8. The Selection Engine (34) selects an initial set of components (48). It applies the criteria that were selected by the provider in (49), that is, it checks the values of the components for those criteria (functionality, QoS, etc). With this selection, the different possible combinations of services are generated (50) and, again, the combinations that are not valid are dismissed. For instance, a combination of services could be dismissed based on the total cost criteria, although individually each service complies with that constraint. Taking into account the global objectives (48), the priorities given in (31) to the different criteria (55), the profiles defined for the providers (56) in the profile manager (28) and the historical information (57), the services combinations are pairwise compared for each criteria (53). As a result of this comparison, the module brings out a ranked list of possible services combination.

Data Flows

Figure 9:
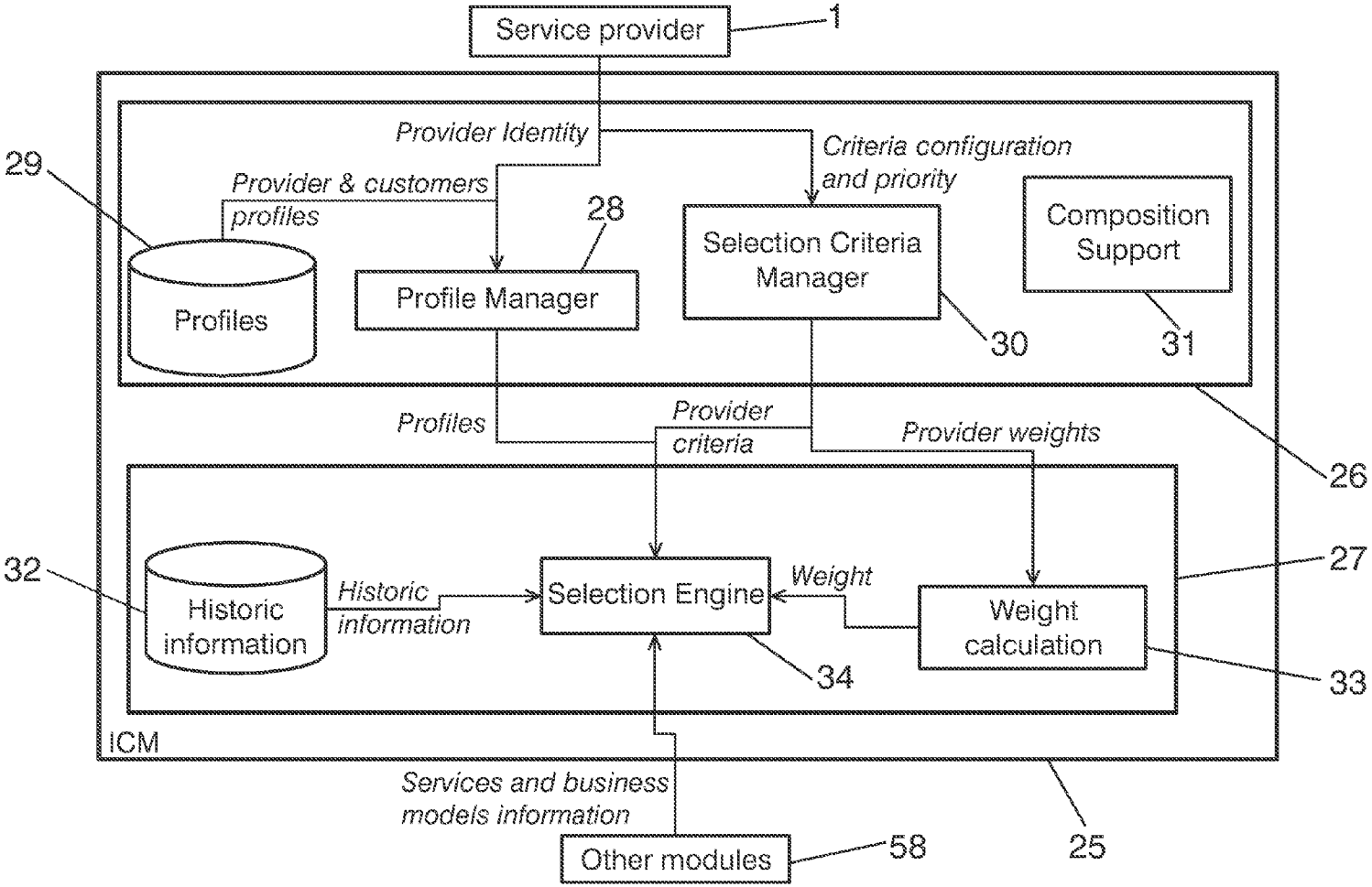
FIG. 9 shows the input of information to the Selection Engine.

FIG. 9 shows the input of information to the Selection Engine (34):

Part of this information comes from the different modules of the ICM (25) where the Selection Engine (34) is located. The Service provider (1) selects and configures the selection criteria and assigns priorities in the Selection Criteria Manager (30). The SCM (309 provides the configured selection criteria to the Selection Engine (34). It also provides the weights obtained from the provider priorities to the Weight Calculation module (33). The Weight Calculation module (33) uses this input in the process of obtaining the final set of weights that is provided to the Selection Engine (34). The Profile Manager (28) gets the provider identity from the Service Provider (1) and retrieves his profile from the Profile repository (29). It also retrieves the customer aggregated profiles and inputs them together with the provider profile to the Selection Engine (34). Finally, the Selection Engine (34) gets the relevant historic information from the Historic information repository (32).

The Selection Engine (34) also gets information from other eMarketPlace modules (58), which are external to the ICM (25). This flow of information is shown in more detail in FIG. 10.

Figure 10:
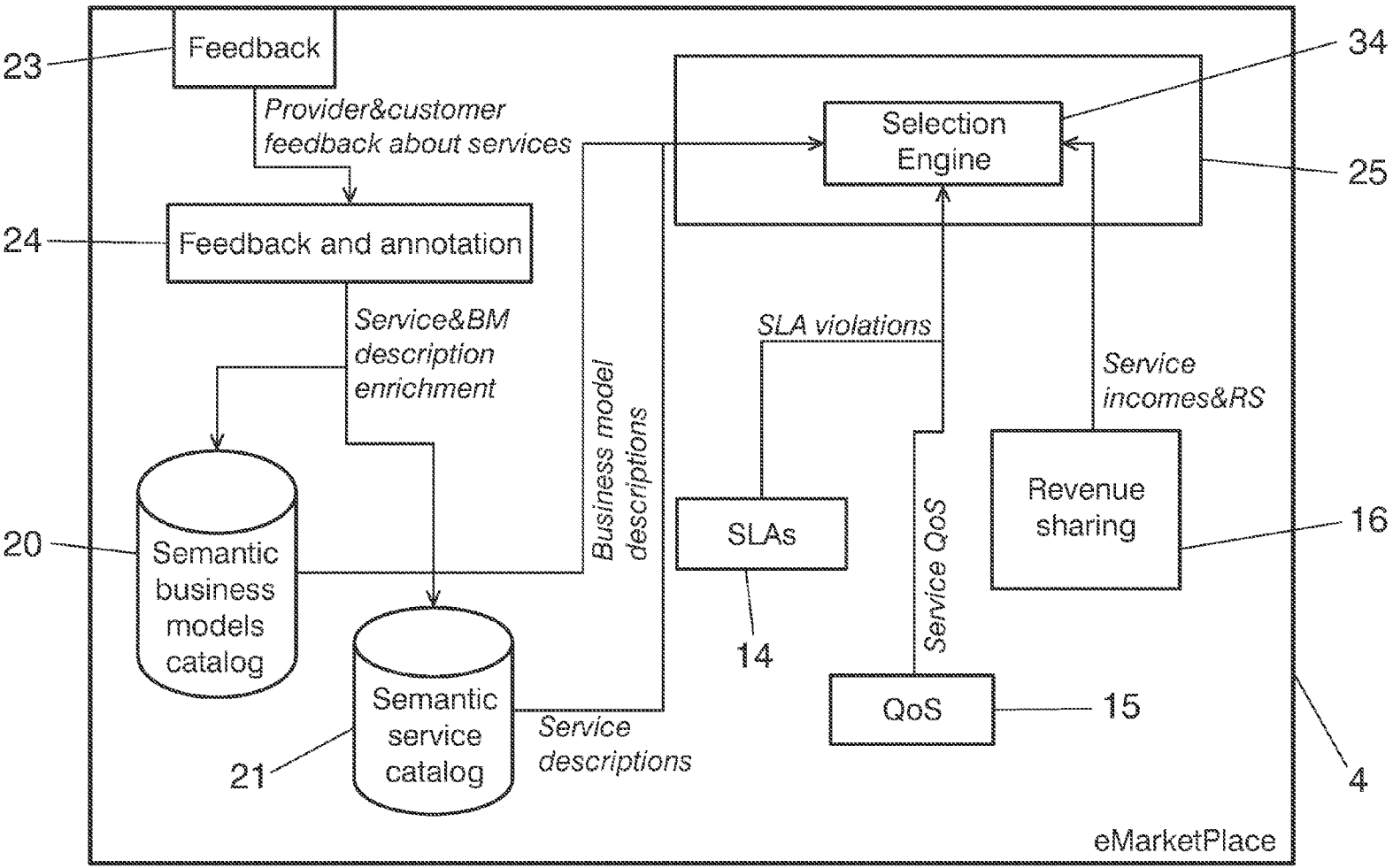
FIG. 10 shows the different e-marketplace modules input the Selection Engine.

FIG. 10 shows how the different eMarketPlace modules input the Selection Engine (34). Customers and providers who use services from the eMarketPlace can input their feedback about their satisfaction through the Feedback interface (23). They can also do semantic annotation of the services through (23), adding key words that provide important information about the services functionality of performance. This input goes to the Feedback and annotation module (24) that interacts with the semantic catalogs (20) and (21) to enrich the information about services and business models with the users feedback.

The Semantic Business Models catalog (20) and the Semantic Service Catalog (21) provide the Selection Engine (34) with the semantic description of services and of their business models so that it can be used in the selection process. The SLA component (14) provides the Selection Engine (34) with information about service SLA and SLA violations. QOS module (15) provides information about service QOS, KPI and performance. Finally, the Revenue Sharing module (16) provides information about the incomes generated by each service and the share that is received by providers.

The Selection Engine (34) uses the information of all these modules as well and the information received from the ICM modules to perform the selection process as described before.

Figure 11:
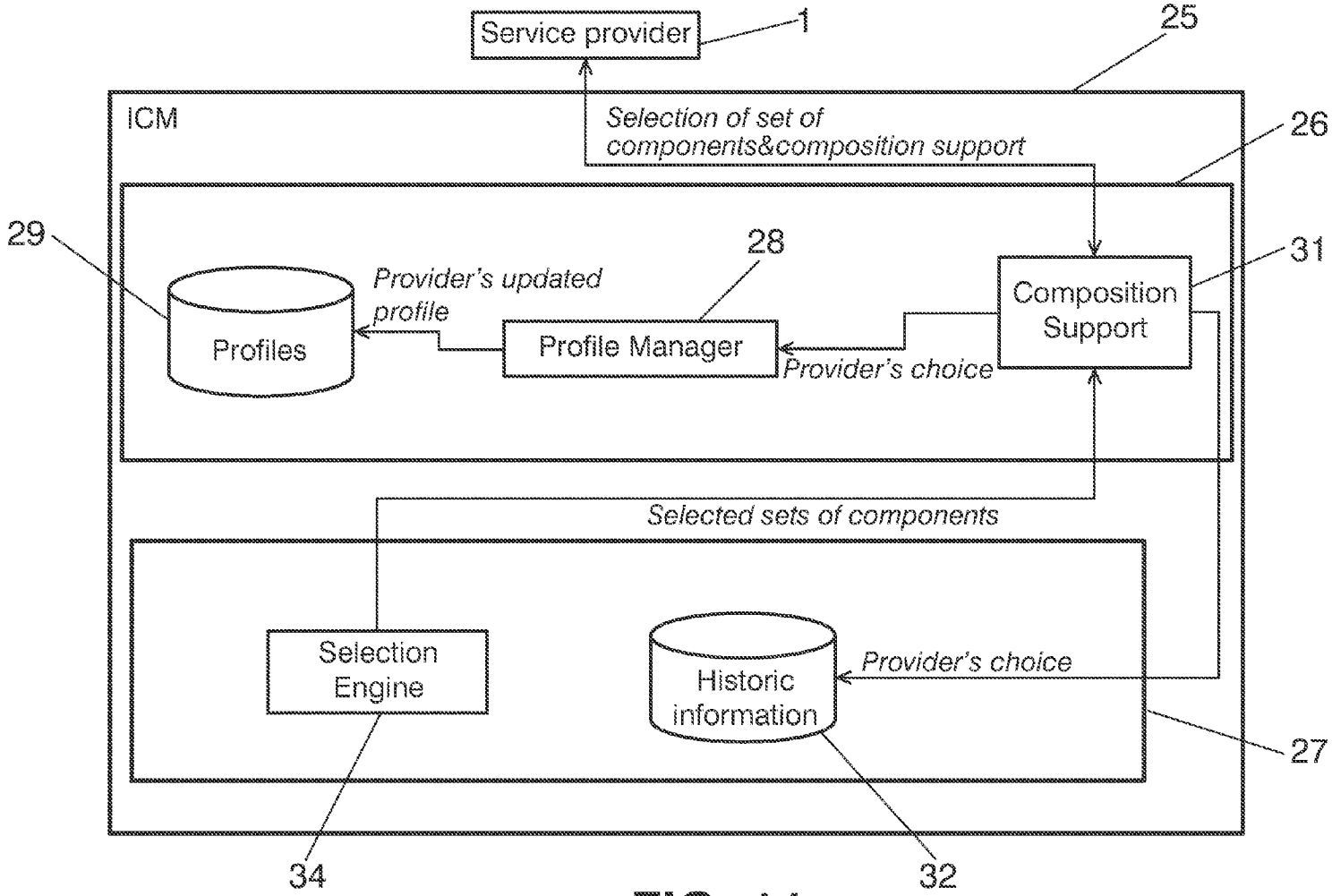
FIG. 11 shows the data flows generated after a selection of components.

When the selection process is finalized, the Selection Engine (34) generates the data flows shown in FIG. 11: the Selection Engine (34) sends the set of components that have been selected to the Composition Support Module (31). The Composition Module (31) provides the Service Provider (1) with the sets of components so that he can select the one he prefers and then supports him in the business model composition process.

Once the Service Provider (1) has chosen a set of components, the Composition Support Module (31) provides this information to a couple of modules that can use it for future selections. It sends the information to the Profile Manager (28). The Profile Manager (28) can extract information about the provider preferences from his final component selection to update his profile in the Profiles repository (29). The Composition Support Module (31) also provides the information to the Historic information repository (32), so that it is kept for future processes.

Use Case

It is depicted an example to illustrate how the proposed system works. In this example, the Service Provider has the following requirements: The Service Provider wants to aggregate several services from the eMarketPlace that should fulfill the following criteria:

- C1: Functionality required by the user. The following functionalities are wanted:
  - Obtaining a map of a city.
  - Obtaining the weather forecast in a city at a given time.
  - Send an SMS to a given phone number.
- C4: Composed service required price. The provider wants the composed service to have a price composed of:
  - Set-up fee: Less than 10 euros. The less expensive, the better.
  - Pay-per-use: less than 2 euros per use. The less expensive, the better.
- C7: QoS. The provider wants to offer at least the following KPI:
  - Availability >80%. The higher, the better.
  - Response time <5 seconds. The lower, the better.
- C10: Services with higher incomes The provider configures those functionalities in the Selection Criteria Manager 30. Using this module, the provider specifies that: The set of components must comply with C1 specifications, C4 and C7 limits.

For those service sets that fulfill these hard criteria, he defines that:

- C10 is more important than C4 and much more important than C7.
- C4 is slightly more important than C7.

For C7, higher availability is more important than response time.

In previous occasions, this provider has always chosen the components that were better valued by customers among all the possible choices. So, even if the provider has not selected criterion C8, this preference is reflected in his profile in 29.

For the sake of simplicity, this use case considers that there are just 4 services in the eMarketPlace:

Service 1 (51) is a mapping service. Generates an average of 100 € per month.

Service 2 (S2) is a weather forecast service. Generates an average of 200 € per month.

Service 3 (S3) offers both a mapping service plus the forecast in the city for which the map is depicted. Generates an average of 350 € per month.

Service 4 (S4) is SMS service. Generates an average of 1000 € per month.

Service 5 (S5) is also a SMS service. Generates an average of 2000 € per month.

The Selection Engine (34) gets the provider criteria from the Selection Criteria Manager (30) and the profile from the Profile Manager (28). The Weight calculation module provides weights for the criteria, taking into account the specified subjective preferences and applying the AHP-based algorithm. With this information, plus the information from previous selection coming from the Historic information module (32), the Selection Engine (34) starts the selection process.

The functional and non-functional hard criteria can be fulfilled with the following service combinations: S1+S2+S4

S1+S2+S5

S3+S4

S3+S5

The application of the algorithm, which makes a pair wise comparison of all for options, taking into account all the criteria, would make the following ranking:

1. S1+S2+S5 (0.4)
2. S3+S5 (0.3)
3. S3+S4 (0.2)
4. S1+S2+S4 (0.1

And the Selection Engine would also show the final features of each combination and their ranking for every criterion. With this information, the service provider can choose the service combination of his preference.

The invention claimed is:

1. A method of improving a selection of a plurality of services in an exchange services environment by a user of a telecommunication network, the method comprising the steps of:

(a) defining a first set of requirements in a selection criteria manager module to be fulfilled by the plurality of services;

(b) searching among the plurality of services, according to services functionalities defined in a service catalog and matching the first set of requirements;

(c) discarding services which do not fulfill the first set of requirements;

(d) defining a second set of requirements in the selection criteria manager module, the second set of requirements indicating user preferences;

(e) assigning, by a processor, weights to services meeting the second set of requirements, the weights taking into account the second set of requirements, data from an historical information module of previous selections by the user, and data from a profile of the first user with previous user preferences;

(f) arranging, by a processor, all service combinations according to the weights obtained, the first service combination being the most optimal selection;

(g) storing the selection of the user at the historical information module; and (h) checking information about a service level agreement made between the user and the service provider relating to the plurality of services available in the exchange services environment, the agreement including violations of the service level agreement.

2. The method according to claim 1, wherein step (e) is performed using a Analytic Hierarchy Process based algorithm.

3. The method of claim 1, wherein step (e) is performed by considering user feedback about the plurality of services.

4. The method according to claim 1, wherein step (b) is performed using semantic descriptions.

5. The method according to claim 1, further comprising a step of checking a quality of service of each of the plurality of services available in the exchange services environment.

6. The method according to claim 1, wherein the first and second requirements defined in the selection criteria manager are selected from a functionality required by the user; a preferred number of components; a service required price; a quality of service; and service statistics.

7. The method according to claim 1, wherein the exchange services environment is an electronic marketplace.

8. A system comprising:

a processor, the processor executing a program code adapted to perform the steps comprising (a) defining a first set of requirements in a selection criteria manager module to be fulfilled by the plurality of services;

(b) searching among the plurality of services, according to services functionalities defined in a service catalog and matching the first set of requirements;

(c) discarding services which do not fulfill the first set of requirements;

(d) defining a second set of requirements in the selection criteria manager module, the second set of requirements indicating user preferences;

(e) assigning weights to services meeting the second set of requirements, the weights taking into account the second set of requirements, data from an historical information module of previous selections by the user, and data from a profile of the first user with previous user preferences;

(f) arranging all service combinations according to the weights obtained, the first service combination being the most optimal selection;

(g) storing the selection of the user at the historical information module; and (h) checking information about a service level agreement made between the user and the service provider relating to the plurality of services available in the exchange services environment, the agreement including violations of the service level agreement.

9. A non-transitory computer readable medium storing a program code which, when executed by a processor, is adapted to perform the steps comprising:

(a) defining a first set of requirements in a selection criteria manager module to be fulfilled by the plurality of services;

(b) searching among the plurality of services, according to services functionalities defined in a service catalog and matching the first set of requirements;

(c) discarding services which do not fulfill the first set of requirements;

(d) defining a second set of requirements in the selection criteria manager module, the second set of requirements indicating user preferences;

(e) assigning weights to services meeting the second set of requirements, the weights taking into account the second set of requirements, data from an historical information module of previous selections by the user, and data from a profile of the first user with previous user preferences;

(f) arranging all service combinations according to the weights obtained, the first service combination being the most optimal selection;

(g) storing the selection of the user at the historical information module; and (h) checking information about a service level agreement made between the user and the service provider relating to the plurality of services available in the exchange services environment, the agreement including violations of the service level agreement.

10. A method of improving a selection of a plurality of services in an exchange services environment by a first user of a telecommunication network, the method comprising the steps of:

(a) defining a first set of requirements in a selection criteria manager module to be fulfilled by the plurality of services;

(b) searching among the plurality of services, according to services functionalities defined in a service catalog and matching the first set of requirements;

(c) discarding services which do not fulfill the first set of requirements;

(d) defining a second set of requirements in the selection criteria manager module, the second set of requirements indicating user preferences;

(e) assigning, by a processor, weights to services meeting the second set of requirements, the weights taking into account the second set of requirements, data from an historical information module of previous selections by the first user, and data from a profile of the first user with previous user preferences;

(f) arranging, by a processor, all service combinations according to the weights obtained, the first service combination being the most optimal selection;

(g) storing the selection of the user at the historical information module; and wherein the first user is a service provider selecting services to be added to a plurality of user-provided services provided by the service provider to offer a composed service to a second user, further comprising the step of checking information regarding income generated by each service and a share of the income that is received by the service provider in the composed service.

11. The method according to claim 10, wherein the first and second requirements defined in the selection criteria manager for the service provider are selected from a composed service level agreement; a total price margin for the composed service provider; and a composed service revenue share.

* * * * *